United States Patent [19]

Grueber

[11] Patent Number: 4,728,298

[45] Date of Patent: Mar. 1, 1988

[54] CONTACT MEMBER

[75] Inventor: Franz Grueber, Munich, Fed. Rep. of Germany

[73] Assignee: Siemens Aktiengesellschaft, Berlin and Munich, Fed. Rep. of Germany

[21] Appl. No.: 868,533

[22] Filed: May 30, 1986

[30] Foreign Application Priority Data

Jun. 20, 1985 [DE] Fed. Rep. of Germany ..... 3522072

[51] Int. Cl.[4] ..... H01R 4/24

[52] U.S. Cl. ..... 439/401

[58] Field of Search ..... 439/389, 391, 395, 396, 439/397, 399, 400, 401, 436–441

[56] References Cited

U.S. PATENT DOCUMENTS

| | | | |
|---|---|---|---|
| 2,911,616 | 11/1959 | Townsend | 339/233 |
| 3,188,380 | 6/1965 | Lorenz | 174/75 |
| 3,964,816 | 6/1976 | Narozny | 339/99 |
| 4,561,179 | 12/1985 | Brush, Sr. et al. | 339/97 R X |

FOREIGN PATENT DOCUMENTS

| | | |
|---|---|---|
| 0112051 | 6/1984 | European Pat. Off. . |
| 699575 | 8/1967 | France . |
| 2415374 | 8/1967 | France . |
| 2454191 | 11/1980 | France . |
| 2454195 | 11/1980 | France . |
| 1442793 | 7/1976 | United Kingdom . |

*Primary Examiner*—John McQuade

*Attorney, Agent, or Firm*—Hill, Van Santen, Steadman & Simpson

[57] ABSTRACT

The contact member comprising knife-edge pinch contact is based on a sheet metal blank bent U-shaped wherein a wall containing the contacting slot is formed by a portion of one of the U-legs of the sheet metal blank which is angled off door-like into the region of the U-contour. Tabs are cut free from the limiting walls of the U-contour and are bent out such with their free ends that the free ends of the tabs press into the insulating layer of a conductor which is pressed into the contacting slot. Points provided at the free ends of the tabs thereby dig into the insulating layer of the conductor and thus, effect a mechanical relief of the actual knife-edge pinch contact location given a simple format of the contact member.

4 Claims, 3 Drawing Figures

CONTACT MEMBER

BACKGROUND OF THE INVENTION

1. Field of the Invention

The invention relates to a contact member formed by bending from a one-piece sheet metal blank which comprises a contacting slot fitted for the impression of a conductor into the slot and which further comprises a closed end at one side, and side walls directed at right angles to the plane of knife-edge pinch contact legs which limit the contacting slot and placed parallel to the course of a conductor pressed into the contacting slot, as well as comprising two tabs which are respectively cut free from two longitudinal side walls residing opposite one another and directed parallel to the course of the contacting slot and having their free ends bend out of the longitudinal side walls in the direction toward the closed end of the contacting slot.

2. Description of the Prior Art

Such a contact member as described above is already known from French Pat. No. 24 54 191. The two tabs cut free from the longitudinal side walls of the contact member are thereby arranged pyramid-like in the direction toward the closed end of the contacting slot. A conductor which is pressed into the contacting slot first presses the tabs apart with their free ends. When they spring back, the tabs then gough into the insulation envelope of the conductor. The tabs can thereby intercept tensile stresses acting on the conductor in the running direction of the conductor and can thus relieve the knife-edge pinch contact location of the contact member.

SUMMARY OF THE INVENTION

In comparison thereto, an object of the present invention is to make a contact member of the type described above even more adaptable in effect to intercepting tensile stresses of conductors which may also differ in diameter.

In accord with the invention, this object is resolved in that a further tab bent out from a transverse side wall directed at right angles relative to the contacting slot and provided at the side of the closed end of the contacting slot is provided and has its free end directed toward the contacting slot.

It can be provided in a further, advantageous development of the invention that the free ends of the tabs are provided with a sawtooth-like design which is fashioned for impression into the insulation of a conductor pressed into the contacting slot.

The retaining effect of the tabs with respect to the contacted conductor is thereby further intensified.

Finally, it can also be provided in the framework of the present invention that the longitudinal sidewalls are formed by the U-legs of the bent sheet metal blank and the transverse side wall is formed by the base of the sheet metal blank bent into a U-shape and that the knife-edge contact legs are a component part of a portion of one of the two U-legs of the sheet metal blank which is angled off door-like in the region of the U-contour.

In conjunction with the structure of the mechanical retaining mechanism of the contact member, a stable knife-edge contact location is created in this fashion, since the knife-edge pinch contact legs limiting the contacting slot are supported at the longitudinal side walls or, respectively are connected thereto.

BRIEF DESCRIPTION OF THE DRAWINGS

Thereby shown greatly enlarged and in a schematic fashion are:

FIG. 2 is a top elevational view of the contact member from; and

DESCRIPTION OF THE PREFERRED EMBODIMENTS

Figure 1:
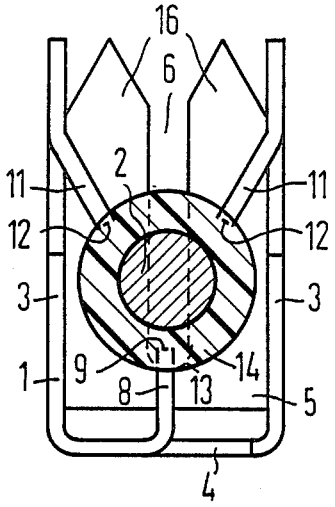
FIG. 1 is a front elevational view of the contact member in the running direction of a contacted conductor.

It may be derived in detail from the Figures, that a contact member 1 is formed of a one-piece sheet metal blank which is bent into a U-shaped configuration. Two longitudinal side walls 3 thereby reside opposite one another, these being connected to one another at one side by a transverse side wall 4. A portion 5 of one of the two longitudinal side walls 3 is angled off door-like in the region of the U-contour formed by the longitudinal side walls 3 and the transverse side wall 4. A contacting slot 6 which is closed at the side of the transverse side wall 4 is worked into this section 5 symmetrically relative to the two longitudinal side walls 3. The contacting slot is likewise open at the open side of the U-contour limited by the side walls 3, 4 so that a conductor 2 having a course directed at right angles relative to the slot 6 can be pressed into the slot 6 proceeding from this side.

The free end of the portion 5 is also supported against an end face 7 of the other longitudinal side wall 3 which is not continuous with the portion 5.

A cut-free tab 8 is bent out of the transverse side wall 4 such that it is directed toward the slot 6 and has its free end 9 projecting slightly from a closed end 13 of the slot 6 into the slot region. The conductor 2 pressed into the slot is therefore also pressed against the free end 9 of the tab 8 when it is impressed. The free end 9 therefore digs into an insulating envelope 14 of the conductor 2.

Two further tabs 22 symmetrical to one another with respect to the slot 6 are bent out of the longitudinal side walls 3, namely, such that the two tabs 11 have their ends 12 directed approximately toward the closed end 13 of the contacting slot 6. As a result, the tabs 11 are arranged pyramid-like in the direction toward the closed end 13 of the contacting slot 6. A conductor 2 which is pressed into the contacting slot 6 first forces the free ends 12 of the tabs 11 apart. When the tabs 11 spring back, they then dig into the insulating envelope 14 of the conductor 2.

Figure 2:
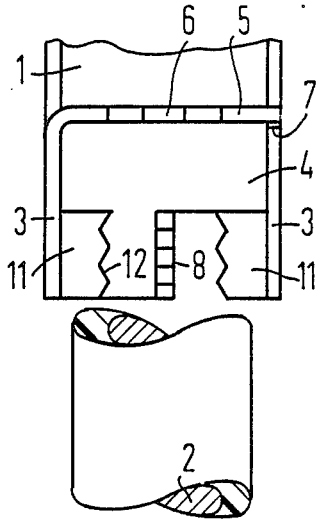
Figure 3:
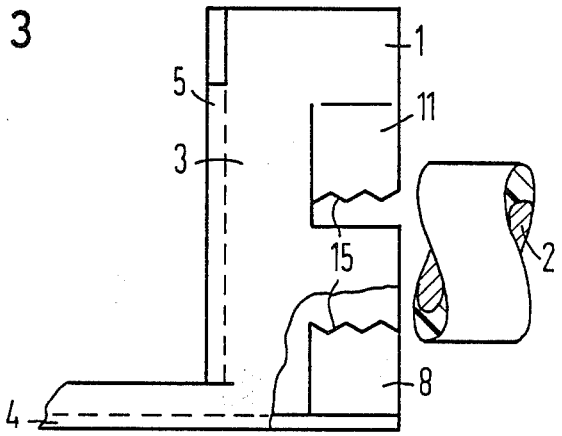
FIG. 3 is a side elevational view of the contact member.

As FIGS. 2 and 3 show, the tabs 8 and 11 are provided with saw-tooth-like structures 15 at their free ends, whereby the retaining effect exerted on the conductor 2 by the tabs is further intensified.

As a result of the special structure of the contact member, the tabs 11 can be dimensioned relatively long in the running direction of the conductor 2, whereby a further improvement in the retaining effect of the tabs is achieved.

Given a suitable dimensioning of the length of the tabs 8 or, respectively, 11, it can be achieved that insulator-clad conductors of different thicknesses can be seized by the tabs 8, or, respectively, 11.

As in known knife-edge pinch contacts, knife-edge pinch contact legs 16 limiting the slot 6 are provided with bevels at their free ends in order to promote the penetration of the leg ends into the insulator envelope 14 of a conductor 2 to be pressed into the contacting slot 6.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. In a contact member formed by bending from a one-piece sheet metal blank, comprising a contacting slot which is fitted for the impression of a conductor into said slot and has a closed end at one side, and comprising longitudinal side walls directed at right angles relative to a plane of knife-edge pinch contact legs which limit said contacting slot and placed parallel to the course of a conductor impressed into said contacting slot, as well as comprising two first tabs which are respectively cut free from said longitudinal side walls residing opposite one another and directed parallel to the course of said contacting slot, and having their free ends bent out of said longitudinal side walls in the direction toward the closed end of said contacting slot, the improvement comprising a further tab bent out of a transverse side wall directed at right angles relative to said contacting slot which has its free end directed toward said contacting slot projecting slightly from said closed end of said slot into the slot region such that a conductor which is pressed into the slot is also pressed against said free end of said further tab and held there by a spring back action of said first tabs and wherein said longitudinal side walls are formed by the U-legs of and said transverse side wall is formed by the base of the sheet metal blank bent into a U-shaped configuration; and in that the knife-edge pinch contact legs are a component part of a portion of one of the two U-legs of the sheet metal blank which is angled off door-like into the region of the U-shaped configuration.

2. A contact member according to claim 1, wherein said tabs are provided with a saw-tooth-like design at their free ends which is fashioned for impression into the insulation of a conductor pressed into said contacting slot.

3. A contact member formed by bending from a one-piece sheet metal blank comprising:

a pair of opposed longitudinal side walls and a transverse side wall bent into a U-shaped configuration;

a transverse rear wall bent from one of said sidewalls to be perpencidular to each of said side walls;

said rear wall having a closed end slot formed therein defining a spaced pair of knife-edge pinch contact legs;

said longitudinal side walls each having a first tab cut and bent therefrom with a free end of said tabs directed toward said closed end of said slot;

said transverse side wall being positioned at said closed end side of said slot and having a further tab cut and bent therefrom with a free end of said tab directed toward said slot projecting slightly from said closed end of said slot into the slot region such that a conductor which is pressed into the slot is also pressed against said free end of said further tab and held there by a spring back action of said first tabs.

4. A contact member according to claim 3, wherein said tabs have saw-tooth profiled ends for engagment into an insulation covering of an electrical conductor pressed into said slot.

* * * * *